US011228136B2

(12) United States Patent
Kawaguchi et al.

(10) Patent No.: US 11,228,136 B2
(45) Date of Patent: Jan. 18, 2022

(54) WIRE HARNESS SEAL

(71) Applicants: AUTONETWORKS TECHNOLOGIES, LTD., Yokkaichi (JP); SUMITOMO WIRING SYSTEMS, LTD., Yokkaichi (JP); SUMITOMO ELECTRIC INDUSTRIES, LTD., Osaka (JP)

(72) Inventors: Tomoya Kawaguchi, Yokkaichi (JP); Masaharu Suetani, Yokkaichi (JP); Akio Kimura, Yokkaichi (JP)

(73) Assignees: AUTONETWORKS TECHNOLOGIES, LTD., Mie (JP); SUMITOMO WIRING SYSTEMS, LTD., Mie (JP); SUMITOMO ELECTRIC INDUSTRIES, LTD., Osaka (JP)

( * ) Notice: Subject to any disclaimer, the term of this patent is extended or adjusted under 35 U.S.C. 154(b) by 0 days.

(21) Appl. No.: 16/981,519

(22) PCT Filed: Mar. 11, 2019

(86) PCT No.: PCT/JP2019/009568
§ 371 (c)(1),
(2) Date: Sep. 16, 2020

(87) PCT Pub. No.: WO2019/188161
PCT Pub. Date: Oct. 3, 2019

(65) Prior Publication Data

US 2021/0013669 A1 Jan. 14, 2021

(30) Foreign Application Priority Data

Mar. 30, 2018 (JP) ..... JP2018-069925

(51) Int. Cl.
*H01R 13/52* (2006.01)
*H01B 7/02* (2006.01)

(52) U.S. Cl.
CPC ..... *H01R 13/5205* (2013.01); *H01B 7/0275* (2013.01)

(58) Field of Classification Search
CPC ..... H01R 13/5205; H01B 7/0275
See application file for complete search history.

(56) References Cited

U.S. PATENT DOCUMENTS 10,658,787 B2 * 5/2020 An ..... H01R 13/187

FOREIGN PATENT DOCUMENTS

JP H04-068589 U 6/1992
JP 2002-254468 A 9/2002
(Continued)

OTHER PUBLICATIONS

Jun. 4, 2019 International Search Report issued in International Patent Application No. PCT/JP2019/009568.

*Primary Examiner* — Vanessa Girardi
(74) *Attorney, Agent, or Firm* — Oliff PLC

(57) ABSTRACT

A wire harness including: an electric wire that includes a core wire and a covering material that covers the core wire; a connector that is attached to an end of the electric wire; and a seal that is interposed between the electric wire and the connector, wherein: the covering material includes a thin portion, which is thinner than other portions of the covering material, at a portion overlapping the seal in a radial direction, the covering material includes a distal-end non-thin portion and a proximal-end non-thin portion on two sides of the thin portion in a longitudinal direction, a first annular stepped surface is formed between the thin portion and the distal-end non-thin portion, and a second annular
(Continued)

stepped surface is formed between the thin portion and the proximal-end non-thin portion.

3 Claims, 2 Drawing Sheets

(56) References Cited

FOREIGN PATENT DOCUMENTS

| | | | |
|---|---|---|---|
| JP | 2008-204960 | A | 9/2008 |
| JP | 2010-073485 | A | 4/2010 |

* cited by examiner

WIRE HARNESS SEAL

BACKGROUND

The present disclosure relates to a wire harness.

As a wire harness installed in an automobile or the like, a wire harness that includes electric wires and a connector provided at ends of the electric wires has been known (see JP 2008-204960A, for example). This connector includes terminal fittings respectively provided at ends of core wires of the electric wires, and a connector housing holding the terminal fittings. A sealing member is provided between the connector housing and a covering material of the electric wire to prevent liquid such as water from entering from gaps between the connector and the electric wires.

SUMMARY

The sealing member of the wire harness as described above is formed in an annular shape, and a predetermined surface pressure is generated between the sealing member and the covering material of the electric wire that is provided inside the sealing member, thereby sealing (water sealing) between the sealing member and the covering material of the electric wire is performed. At this time, the covering material is deformed by the surface pressure from the sealing member. However, deterioration of the sealing member progresses due to the heat generated in the connector, and the surface pressure between the sealing member and the covering material of the electric wire may decrease, so that the sealing performance may not be maintained.

An exemplary aspect of the disclosure provides a wire harness that can maintain sealing performance.

A wire harness according to an exemplary aspect includes an electric wire that includes a core wire and a covering material that covers the core wire; a connector that is attached to an end of the electric wire; and a seal that is interposed between the electric wire and the connector, wherein the covering material includes a thin portion, which is thinner than other portions of the covering material, at a portion overlapping the seal in a radial direction.

According to the above aspect, because the covering material includes the thin portion that is thinner than other portions at the portion overlapping the seal in the radial direction, the amount of deformation caused by the seal is reduced, as compared with the case in which the seal is attached to the other portion other than the thin portion to generate the same pressure. Accordingly, for example, even when deterioration of the seal progresses due to heat generated in the connector and the surface pressure between the seal and the thin portion (the covering material) decreases, the amount of deformation of the thin portion caused by the seal is smaller than that in the case where the seal is attached to a portion other than the thin portion. Therefore, generation of a gap between the seal and the thin portion can be reduced. With this configuration, the sealing performance can be maintained.

In the wire harness, it is preferable that the thin portion is formed by compressing a part of the covering material inward in the radial direction.

According to the above aspect, because the thin portion is formed by compressing a part of the covering material inward in the radial direction, the thin portion can be formed after the covering material is extrusion-molded for example. Accordingly, the thin portion can be easily formed.

In the above wire harness, it is preferable that the thin portion is provided at a position that is spaced apart from an end in a longitudinal direction of the covering material.

According to the above aspect, because the thin portion is provided at a position spaced apart from the end in the longitudinal direction of the covering material, the thin portion has a shape recessed with respect to a portion of the covering material adjacent to the thin portion, and thus it is possible to easily position the seal.

With the wire harness according to some aspects of the present disclosure, sealing performance can be maintained.

DETAILED DESCRIPTION OF EMBODIMENTS

Hereinafter, an embodiment will be described with reference to the accompanying drawings. Note, that in the accompanying drawings, some components are exaggerated or simplified for illustrative reasons. Also, in the accompanying drawings, the dimensional ratio between portions may be different from the actual ratio.

Figure 1:
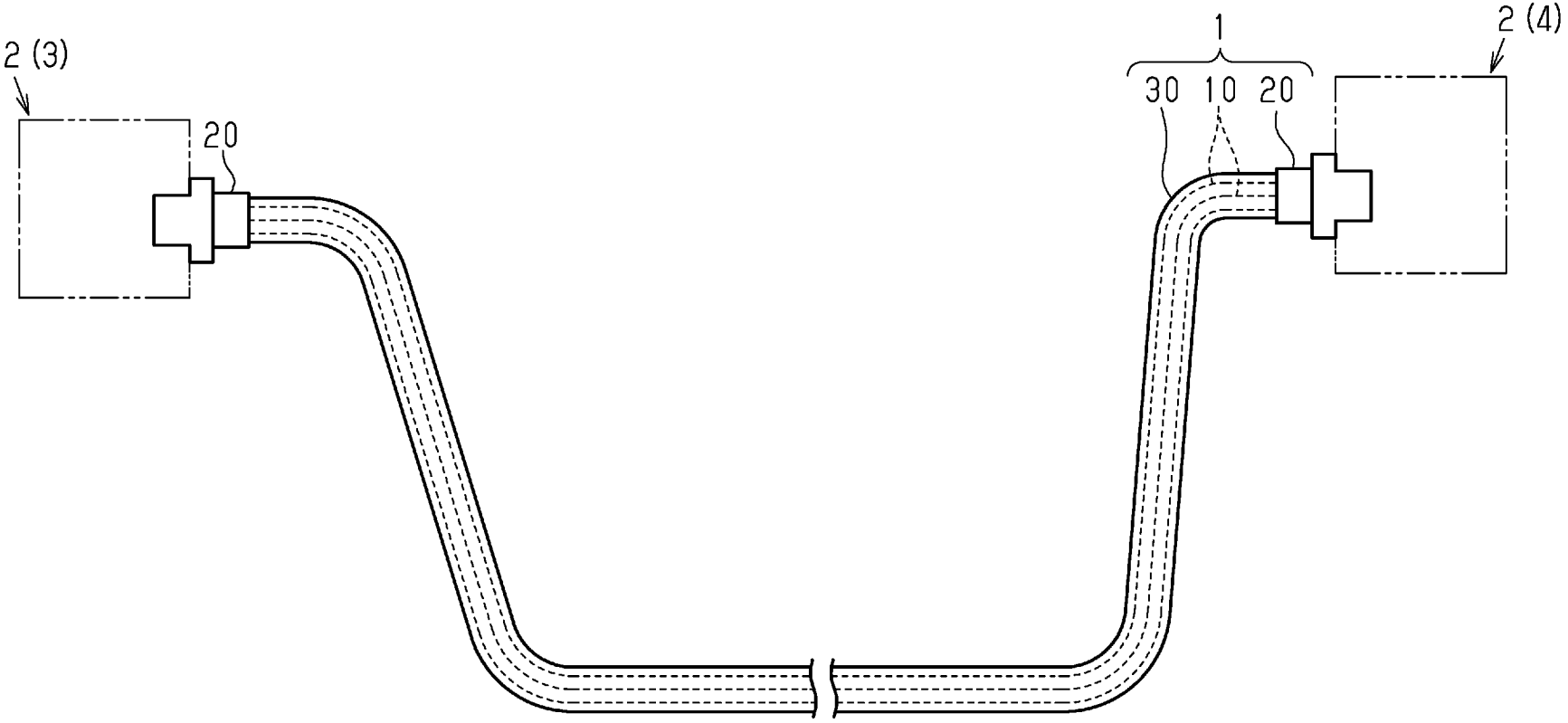
FIG. 1 is a schematic configuration diagram illustrating a wire harness according to an embodiment.

A wire harness 1 shown in FIG. 1 electrically connects two or three or more electronic devices (devices) 2. The wire harness 1 according to the present embodiment electrically connects an inverter 3 installed in a front portion of a vehicle, such as a hybrid vehicle or an electric vehicle, to a high-voltage battery 4 installed behind the inverter 3 in the vehicle. The wire harness 1 is routed to pass under the floor of the vehicle, for example. The inverter 3 is connected to a wheel driving motor (not shown) that serves as a power source for driving the vehicle. The inverter 3 generates alternating-current (AC) power from the direct-current (DC) power of the high-voltage battery 4, and supplies the AC power to the motor. The high-voltage battery 4 can supply a voltage of, for example, several hundred volts.

The wire harness 1 includes a plurality of (two in the present embodiment) electric wires 10, a pair of connectors 20 attached to the two ends of the electric wires 10, and a protective tube 30 that completely surrounds the plurality of electric wires 10. One connector 20 is connected to the inverter 3, and the other connector 20 is connected to the high-voltage battery 4. As the protective tube 30, for example, a metal or resin pipe, a flexible corrugated tube made of resin or the like, a rubber waterproof cover, or a combination thereof can be used. The protective tube 30 protects the electric wires 10 accommodated therein from flying objects and liquid, for example.

Each electric wire 10 includes a core wire 11 and a covering material 12 covering the outer circumference of the core wire 11. As the core wire 11, for example, a strand wire formed by twisting a plurality of bare metal wires can be used. As a material of the core wire 11, for example, a metal having excellent conductivity, such as copper, a copper alloy, aluminum, or an aluminum alloy, can be used. The covering material 12 covers, for example, the outer circumferential surface of the core wire 11 over the entire circumference in an intimate contact state. The covering material 12 is made of, for example, an insulating material such as cross-linked polyethylene. The covering material 12 can be formed by, for example, extrusion molding (extrusion covering) on the core wire 11.

Figure 2:
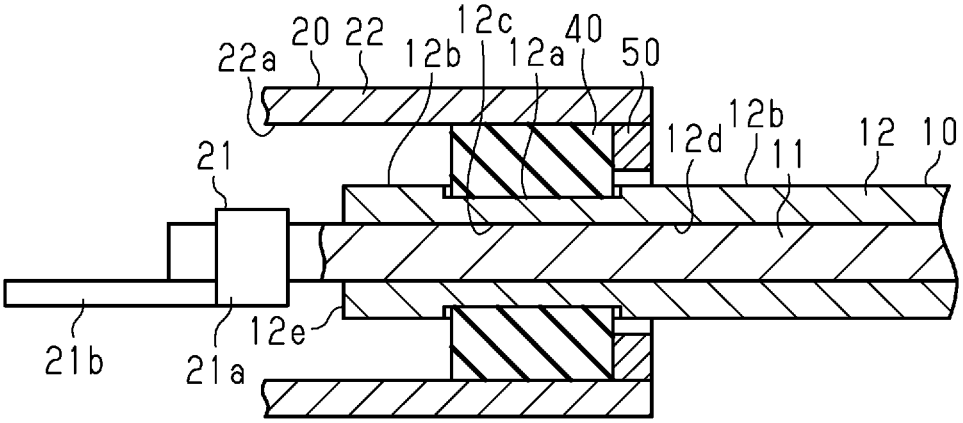
FIG. 2 is a cross-sectional view around a connector of the wire harness according to the embodiment.

As shown in FIG. 2, the connectors 20 each include terminal fittings 21 and a connector housing 22.

The terminal fittings 21 are respectively connected to the ends of the electric wires 10. The terminal fittings 21 each include a barrel portion 21*a* and a terminal portion 21*b*. The barrel portion 21*a* is crimped to the core wire 11 of the electric wire 10 to be electrically connected to the core wire 11 of the electric wire 10.

The connector housing 22 is formed in a substantially tubular shape, for example. The connector housing 22 is made of a resin member.

Further, the wire harness 1 according to the present embodiment includes a sealing member 40 (seal) between an inner circumferential surface 22*a* of the connector housing 22 and the covering material 12.

A rubber plug can be used as the sealing member 40, for example. The sealing member 40 is held between the inner circumferential surface 22*a* of the connector housing 22 and the covering material 12 in a state of intimate contact with the connector housing 22 and the covering material 12 over the entire circumferential direction. A retainer 50 is attached to the side of the connector housing 22 opposite to the terminal fitting 21 with respect to the sealing member 40.

Here, the covering material 12 includes a thin portion 12*a* in which a portion abutting on the sealing member 40 in the radial direction is thinner than other portions. The thin portion 12*a* is formed over the entire circumferential direction of the covering material 12 at a position spaced apart from an end 12*e* of the covering material 12. The thin portion 12*a* has a shape that is recessed inward in the radial direction with respect to an outer circumferential surface 12*b* of the portion other than the thin portion 12*a* of the covering material 12. Further, the thin portion 12*a* is configured such that an inner circumferential surface 12*c* thereof is substantially flush with an inner circumferential surface 12*d* other than the thin portion 12*a* of the covering material 12. The thin portion 12*a* is formed by, for example, heating the covering material 12 to make the covering material 12 easily deformable, compressing the covering material 12 inward in the radial direction, and then cooling the covering material 12. The thin portion 12*a* is formed before the sealing member 40 is attached to the outer circumference of the covering material 12.

The operation of the present embodiment will be described next.

The wire harness 1 of the present embodiment includes the thin portion 12*a*, which is thinner than other portions, at a portion of the covering material 12 that overlaps (abuts on) the sealing member 40 in the radial direction. With this configuration, even when pressure is applied from the sealing member 40 to the covering material 12 side (inward in the radial direction), the amount of deformation of the thin portion 12*a* due to the pressure from the sealing member 40 is reduced, because the amount of deformation of the thin portion 12*a* is limited compared to the amount of deformation of the portion of the covering material 12 other than the thin portion 12*a*.

The effects of the present embodiment will be described next.

(1) Because the covering material 12 includes the thin portion 12*a*, which is thinner than other portions, at the portion overlapping the sealing member 40 in the radial direction, the amount of deformation due to the sealing member 40 is reduced, as compared with the case in which the same pressure is generated by attaching the sealing member 40 to the other portion other than the thin portion 12*a*. As a result, even when the sealing member 40 deteriorates due to heat generated in the connector 20 and the surface pressure between the sealing member 40 and the thin portion 12*a* (the covering material 12) decreases, the amount of deformation of the thin portion 12*a* due to the sealing member 40 is smaller than that in the case in which the sealing member 40 is attached to a portion other than the thin portion 12*a*. Accordingly, generation of a gap between the sealing member 40 and the thin portion 12*a* is reduced. With this configuration, the sealing performance can be maintained.

(2) Because the thin portion 12*a* is formed by compressing a part of the covering material 12 inward in the radial direction, the thin portion 12*a* can be formed after the covering material 12 is extrusion-molded, for example. Accordingly, the thin portion 12*a* can be easily formed.

(3) By providing the thin portion 12*a* at a portion spaced apart from the end 12*e* in the longitudinal direction of the covering material 12, the thin portion 12*a* has a recessed shape with respect to a portion of the covering material 12 adjacent to the thin portion 12*a*. Accordingly, the sealing member 40 can be easily positioned.

The above embodiment may also be modified as follows.

In the above embodiment, the thin portion 12*a* is provided at a position spaced apart from the end 12*e* in the longitudinal direction of the covering material 12, but the present disclosure is not limited to this configuration. A configuration may also be adopted in which the thickness is reduced from the one end 12*e* to a predetermined position toward the other end 12*e*, for example.

In the above embodiment, the thin portion 12*a* is formed by compressing a part of the covering material 12 inward in the radial direction, but the present disclosure is not limited to this. The thin portion 12*a* may also be formed by thinning a part of the covering material 12 by cutting or the like, for example.

The outer circumferential surfaces (12*a* and 12*b*) of the covering material 12 may be referred to as a radially outward surface of the covering material 12. The outer circumferential surface and the inner circumferential surface of the sealing member 40 may be referred to as a radially outward seal surface and the radially inward seal surface of the sealing member 40, respectively.

The thin portion 12*a* of the covering material 12 may be referred to as a small diameter portion of the covering material 12 (or, of the electric wire 10) formed on the outer circumferential surface of the covering material 12 at a local position of the covering material 12 in the longitudinal direction. Non-thin portions, which are portions on the two sides of the thin portion 12*a* in the longitudinal direction, for example, remaining portions of the covering material 12 excluding the thin portion 12*a* of the covering material 12 may be referred to as a large diameter portion of the covering material 12. The diameter of the covering material 12 in the non-thin portion, that is to say, the diameter of the covering material 12 in the large diameter portion may be referred to as a first diameter. In a state where the sealing member 40 is not in contact with the small diameter portion of the covering material 12, the diameter of the covering material 12 in the small diameter portion has a second diameter that is smaller than the first diameter. In the illustrated example, the covering material 12 is a single covering material layer.

The sealing member 40 is sandwiched in the radial direction between the inner circumferential surface 22*a* of the connector housing 22 and the outer circumferential surface of the small diameter portion of the covering material 12, and is held in a compressed state in the radial direction between the inner circumferential surface 22*a* of the connector housing 22 and the outer circumferential surface of the small diameter portion of the covering material 12. The outer circumferential surface and the inner circumferential surface of the sealing member 40 are respectively in intimate contact with the inner circumferential surface 22*a* of the connector housing 22 and the outer circumferential surface of the small diameter portion of the covering material 12, preferably in a liquid-tight manner. In the illustrated example, the sealing member 40 is a single member or a one-piece member.

In the illustrated example, in the state where the sealing member 40 is not in contact with the small diameter portion of the covering material 12, the small diameter portion of the covering material 12 and the large diameter portions on the two sides of the small diameter portion in the longitudinal direction form two steps in the covering material 12. These steps may be referred to as a distal-end stepped surface and a proximal-end stepped surface of the covering material 12, respectively.

In a non-limiting example, the sealing member 40 includes a distal-end annular end surface close to the terminal fitting 21, and a proximal-end annular end surface close to the opening of the connector housing 22. The non-thin portions on the two sides of the thin portion 12*a* in the axial direction may be referred to as a distal-end non-thin portion and a proximal-end non-thin portion, respectively. The length of the thin portion 12*a* in the axial direction is longer than the length of the sealing member 40 in the axial direction, that is to say, the length from the distal-end annular end surface to the proximal-end annular end surface of the sealing member 40. Therefore, the sealing member 40 does not come into contact with one or both of the distal-end non-thin portion and the proximal-end non-thin portion.

The above-mentioned embodiment and modifications may also be combined as appropriate.

The present disclosure encompasses the following implementation examples. The reference numerals of the constituent elements of the embodiments are attached for the sake of understanding, not for limitation.

Additional Remark 1

A wire harness (1) according to some implementation examples includes: an electric wire (10) including a core wire (11) and an insulating covering layer (12) that covers the core wire (11); a terminal fitting (21) fixed to an exposed distal-end portion of the core wire (11) protruding from an end surface (12*e*) of the insulating covering layer (12); a connector housing (22) including an opening for passing the electric wire (10), and an inner circumferential surface (22*a*) surrounding at least a connecting portion between the core wire (11) and the terminal fitting (21) from the outside; a tubular sealing member (40) that is attached to the inner circumferential surface (22*a*) of the connector housing (22); and a retainer (50) that is attached to the opening of the connector housing (22), and that is in contact with the sealing member (40) to prevent the sealing member (40) from being detached from the connector housing (22), wherein the insulating covering layer (12) includes a small diameter portion (12*a*) formed at a local position (12*a*) of the insulating covering layer (12) in a longitudinal direction on radially outward surfaces (12*a*, 12*b*) of the insulating covering layer (12), and large diameter portions (12*b*) excluding the small diameter portion (12*a*) on the radially outward surfaces (12*a*, 12*b*) of the insulating covering layer (12), and the sealing member (40) is sandwiched in a radial direction between the inner circumferential surface (22*a*) of the connector housing (22) and the radially outward surface of the small diameter portion (12*a*) of the insulating covering layer (12), and is held in a compressed state in the radial direction between the inner circumferential surface (22*a*) of the connector housing (22) and the radially outward surface of the small diameter portion (12*a*) of the insulating covering layer (12).

Additional Remark 2

In some implementation examples, the large diameter portions (12*b*) of the insulating covering layer (12) are thick portions each having a first thickness in a state where the sealing member (40) is not in contact with the small diameter portion of the insulating covering layer (12), and the small diameter portion (12*a*) of the insulating covering layer (12) is a thin portion having a second thickness that is smaller than the first thickness of the thick portions in a state where the sealing member (40) is not in contact with the small diameter portion of the insulating covering layer (12).

Additional Remark 3

In some implementation examples, the non-thin portions (12*b*) of the insulating covering layer (12) have a first maximum compression deformation amount when compressed in the radial direction at a predetermined pressure, and the thin portion (12*a*) of the insulating covering layer (12) has a second maximum compression deformation amount that is smaller than the first maximum compression deformation amount when compressed in the radial direction at the predetermined pressure.

Additional Remark 4

In some implementation examples, the thin portion (12*a*) is formed by compressing the radially outward surface (12*a*) from the outside at the local position of the insulating covering layer (12).

Additional Remark 5

In some implementation examples, the thin portion (12*a*) is formed by cutting the local position of the insulating covering layer (12) from the outside of the insulating covering layer (12).

Additional Remark 6

In some implementation examples, the sealing member (40) includes a distal-end annular end surface close to the terminal fitting (21) and a proximal-end annular end surface close to the opening of the connector housing (22), and the length of the thin portion (12*a*) in the axial direction is longer than the length of the sealing member (40) in the axial direction, which is the length from the distal-end annular end surface to the proximal-end annular end surface of the sealing member (40).

Additional Remark 7

In some implementation examples, the large diameter portions (12*b*) are large diameter portions (12*b*) formed on the two sides of the small diameter portion (12*a*) in the longitudinal direction, the two large diameter portions (12*b*) and the small diameter portion (12*a*) form two annular stepped surfaces therebetween, and the sealing member (40) does not come into contact with one or both of the two annular stepped surfaces.

It will be apparent to those skilled in the art that the present disclosure may also be embodied in other specific forms without departing from the technical idea thereof. Some of the components described in the embodiment (or one or more aspects thereof) may also be omitted, or some components may also be combined.

The invention claimed is:

1. A wire harness comprising:

an electric wire that includes a core wire and a covering material that covers the core wire;

a connector that is attached to an end of the electric wire; and a seal that is interposed between the electric wire and the connector, wherein:

the covering material includes a thin portion, which is thinner than other portions of the covering material, at a portion overlapping the seal in a radial direction, the covering material includes a distal-end non-thin portion and a proximal-end non-thin portion on two sides of the thin portion in a longitudinal direction, a first annular stepped surface is formed between the thin portion and the distal-end non-thin portion, and a second annular stepped surface is formed between the thin portion and the proximal-end non-thin portion, and the seal is not in contact with one or both of the first annular stepped surface and the second annular stepped surface, and is spaced apart from one or both of the first annular stepped surface and the second annular stepped surface with a gap.

2. The wire harness according to claim 1, wherein the thin portion is formed by compressing a part of the covering material inward in the radial direction.

3. The wire harness according to claim 1, wherein the thin portion is provided at a position that is spaced apart from an end in the longitudinal direction of the covering material.

* * * * *